United States Patent [19]

Lamelot

[11] 4,162,052

[45] Jul. 24, 1979

[54] NIGHT GUIDANCE OF SELF-PROPELLED MISSILES

[75] Inventor: Pierre M. L. Lamelot, Ville d'Avray, France

[73] Assignee: Societe Anonyme de Telecommunications, Paris, France

[21] Appl. No.: 750,813

[22] Filed: Dec. 15, 1976

[30] Foreign Application Priority Data

Dec. 22, 1975 [FR] France ..... 75 39285

[51] Int. Cl.[2] ..... F41G 1/32; F41G 1/36

[52] U.S. Cl. ..... 244/3.16; 358/113; 250/214 B; 250/214 C; 250/339; 250/341

[58] Field of Search ..... 358/113; 244/316; 250/214 B, 214 C, 339, 341

[56] References Cited

U.S. PATENT DOCUMENTS

| | | | |
|---|---|---|---|
| 3,258,529 | 6/1966 | Parrish et al. | 358/113 |
| 3,379,830 | 4/1968 | Menke | 358/113 |
| 3,638,025 | 1/1972 | Dishington et al. | 358/113 |
| 3,751,586 | 8/1973 | Johansson | 358/113 |
| 3,795,811 | 3/1974 | Weir | 250/339 |
| 3,825,754 | 7/1974 | Cinzori et al. | 250/339 |
| 3,944,730 | 3/1976 | Dahlqvist et al. | 358/113 |
| 3,999,060 | 12/1976 | Skagerlund | 250/214 B |

*Primary Examiner*—Samuel W. Engle
*Assistant Examiner*—Thomas H. Webb
*Attorney, Agent, or Firm*—Jacobs & Jacobs

[57] ABSTRACT

A method for masking on the display device associated with a thermal telescope for the night guidance of self-propelled missiles carrying an infrared source, the image of a source of relatively intense stray radiations, wherein, on the one hand, the radiations transmitted in the field of vision of the thermal telescope are simultaneously detected in two different spectral bands, of which the one, called the useful band, corresponds to the maximum radiations from the target and the surrounding landscape, and the other one, called stray band, corresponds to the maximum radiations from the intense infrared sources carried or not by the missile, and on the other hand the signal detected in the first band is corrected by the signal detected in the second band in a manner to leave out the stray portions of the useful signal.

5 Claims, 4 Drawing Figures

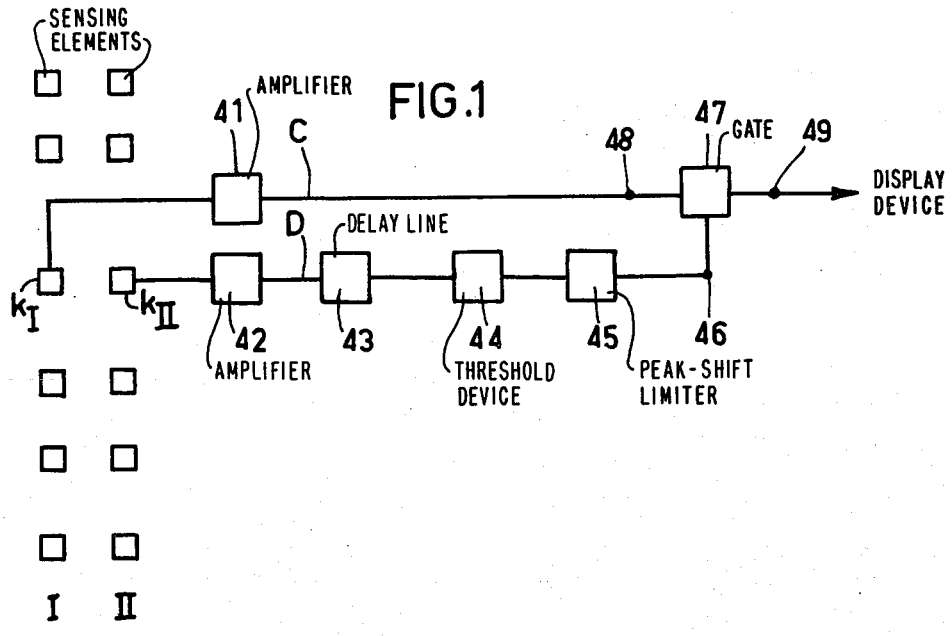
FIG.1
FIG.2
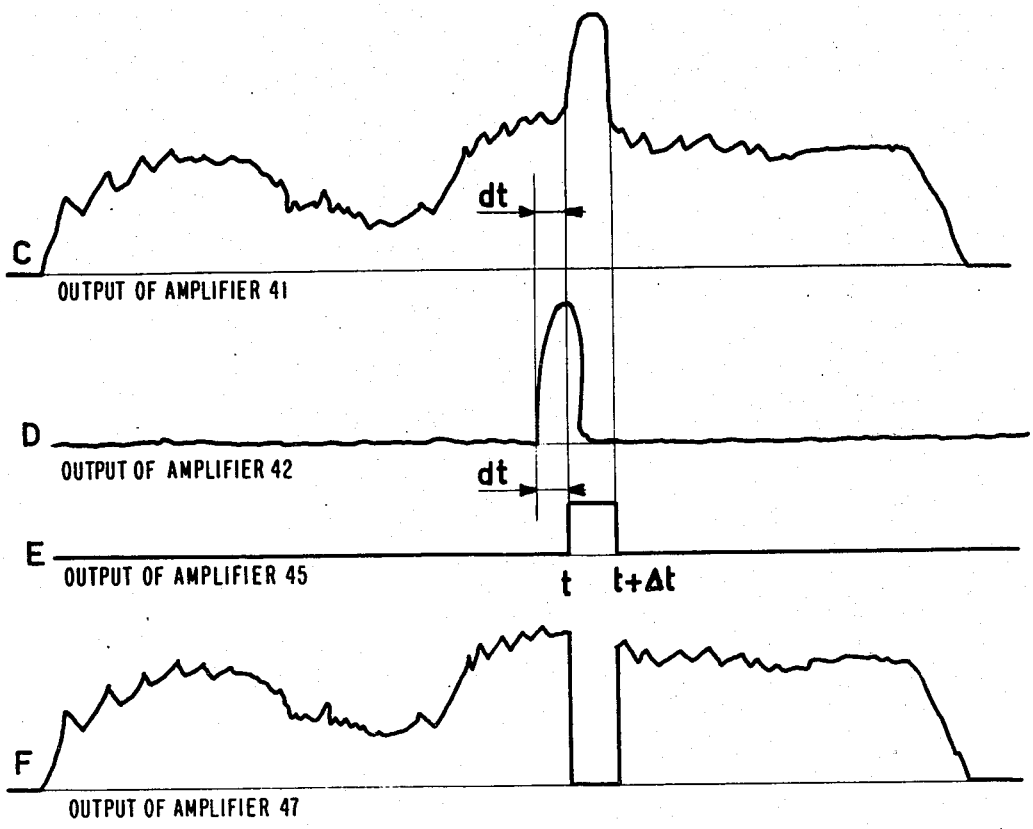

NIGHT GUIDANCE OF SELF-PROPELLED MISSILES

The invention relates to the guidance by night of self-propelled missiles, particularly of missiles guided from a remote-control station towards a mobile or stationary target.

The daylight guidance of such missiles is well known. It is an indirect guidance achieved by alignment on an axis optically defined by the reticle of a sighting telescope having its crossing point being maintained by the observer sitting in the remote control station to coincide with the target. Angular deviations of the missile in relation to the optical axis thus defined are delivered to the observer by means of an infrared goniometry optical device detecting an infrared source called tracer carried by the missile. The system is designed in such manner that the optical axes of the sighting telescope and the infrared goniometer are in coincidence.

For night use of this localizing apparatus, a night observation system of the thermal imagery system type whose optical axis defined by a reticle coincides with the optical axis of the localizing apparatus, has to be associated with the daylight sighting telescope. Such night guiding systems are disclosed in co-pending application of same Applicant.

Such a night observation system comprises either a linear array of infrared sensing elements, called sensor bar, associated with a mechanical scanning device along one axis or two rectangular axes, or a bidimensional array of infrared sensing elements. Said array is placed in the focal plane of an infrared lens and transmits electrical signals whereby the thermal image is converted into a visual image by way of an appropriate device such as for instance a cathode ray tube.

Yet, in a night guiding system of the type hereabove described, night observation and directing of the optical axis of the localizing apparatus are operations which are considerably disturbed by the presence in the field of vision of the thermal telescope of thermopropulsive means, pyrotechnical or thermal tracers carried by the missile and whose radiation is generally intense in the wave-length range where the thermal imagery is formed, i.e. in the 4 to 5 μm or the 8 to 12 μm area.

The object of the present invention is to automatically correct the image presented to the observer by the display device by leaving out the images of the intense infrared sources present in the field of vision of the thermal telescope; said intense infrared sources may be either carried by the missile, or located elsewhere.

French patent No. 1,604,114 discloses a device for masking in a sighting or observation apparatus the image of a source of visible and relatively intense stray radiations. A device derived from the latter for masking on the display device the intense infrared stray sources might have been contemplated, but such a device would comprise a mechanical part uneasy to manipulate and which moreover would not solve the problem arising from the saturation of the electronic circuitry. For this reason, the present invention utilizes entirely electronic and automatic means.

To this effect, there is provided according to the invention, a method for masking on the display device associated to a thermal telescope for the night guidance of self-propelled missiles carrying an infrared source, the image of a source of relatively intense stray radiations, wherein on the one hand, the radiations transmitted in the field of vision of the thermal telescope are simultaneously detected in two different spectral bands of which the one, called the useful band, corresponds to the maximum radiation from the target and the surrounding landscape, and the other one, called stray band, corresponds to the maximum radiation from the intense infrared sources carried or not by the missile, and on the other hand the signal detected in the first band is corrected by the signal detected in the second band to leave out the stray portions of the useful signal.

The first spectral band, also called useful band, is either the 4 to 5 μm or the 8 to 12 μm band whereas the second spectral band, also called stray, is for instance the 1.5 to 2.5 μm band.

In the 1.5 to 2.5 μm band, the radiation of the missile tracers and propellers which originates from the flame or the material heated to a high temperature exceeding 1000° C. is substantially the only one which is detected. In the 4 to 6 μm or the 8 to 12 μm band, the radiation from the target and surrounding landscape and the radiation from the infrared intense sources which are for instance carried by the missile are detected at the same time.

The device for implementing the method according to the invention comprises a thermal telescope associated with bi-spectral detection means and a display device, and is characterized in that it comprises means for processing the signals detected by said bi-spectral detection means, said means correcting the signal detected in the useful spectral band by the signal detected in the stray spectral band in order to decrease the voltage of the stray portion of the first signal down to a value at most equal to that of the useful portion of said signal.

In a first embodiment of the processing means according to the invention, the voltage of the stray portion is reduced to zero for instance by supplying the display device with the signal detected in the first spectral band and amplified, through a gate whose control input is fed by the signal detected in the second spectral band, amplified and shaped by a threshold device followed by a peak-shift limiter.

In this first embodiment, the signal detected in the second spectral band is eventually passed after amplification in a delay line whose value is dependent upon the relative position of the infrared sensors of both spectral bands.

In a second embodiment, the voltage of the stray portion is simply brought back to the level of that of the useful portion of the signal by feeding the display device via a subtracting device receiving the signals detected in the two spectral bands after adjustable amplification and eventual convenient delay.

The sensors pertaining to each spectral band are placed in known manner in the focal plane of the thermal telescope such as disclosed in co-pending application. It should be recalled that they may be associated in various ways: superimposed, placed side by side or inserted in different cryostats. In the latter case, the optical paths of the infrared radiations to be detected are only partially coinciding.

By way of example, the following description which will become more apparent by referring to the accompanying drawings is related to the case where two linear arrays or sensor bars are placed side by side in two parallel lines.

FIG. 1 shows a first embodiment of the video signal processing device according to the invention;

FIG. 2 represents the signals present in the device of FIG. 1;

FIG. 1 shows in block-diagram form a device for processing the signals originating from two sensing elements $k_I$ and $k_{II}$ of the same rank k on each of the two bars I and II placed side by side.

Figure 3:
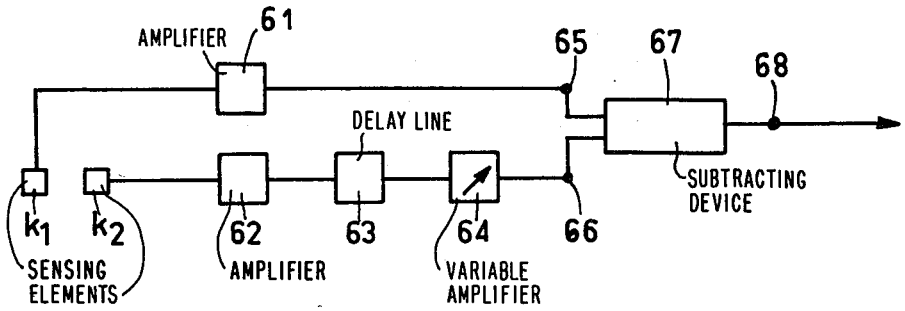
FIG. 3 shows a second embodiment of the processing device.

After amplification respectively in amplifiers 41 and 42, the signals from $k_I$ and $k_{II}$ are such as represented in C and D of FIG. 2, dt is the delay between the moments of detection of the radiation from a point by sensing element $k_I$ of bar I and by the corresponding sensing element $k_{II}$ of bar II. In other words, the elements of same rank of bars I and II scan the same spatial area with a lag dt dependent upon the scanning speed.

Signal D is passed in a delay line 43, threshold device 44 and a peak-shift limiter 45. When emerging from device 45, it appears in the form of a pulse shown in E and is applied at the control input 46 of a gate 47 whose input 48 is supplied by signal C and whose output 49 is to be connected to the display device not shown on the figure. At said output, the signal is as represented in F of FIG. 2. In FIG. 2, it may be seen that signal F has been cancelled out for the duration of the impulse of signal E. The display device will therefore show a dark spot instead of the dazzling spot which the missile tracer would have produced without the device according to the invention being present.

Figure 4:
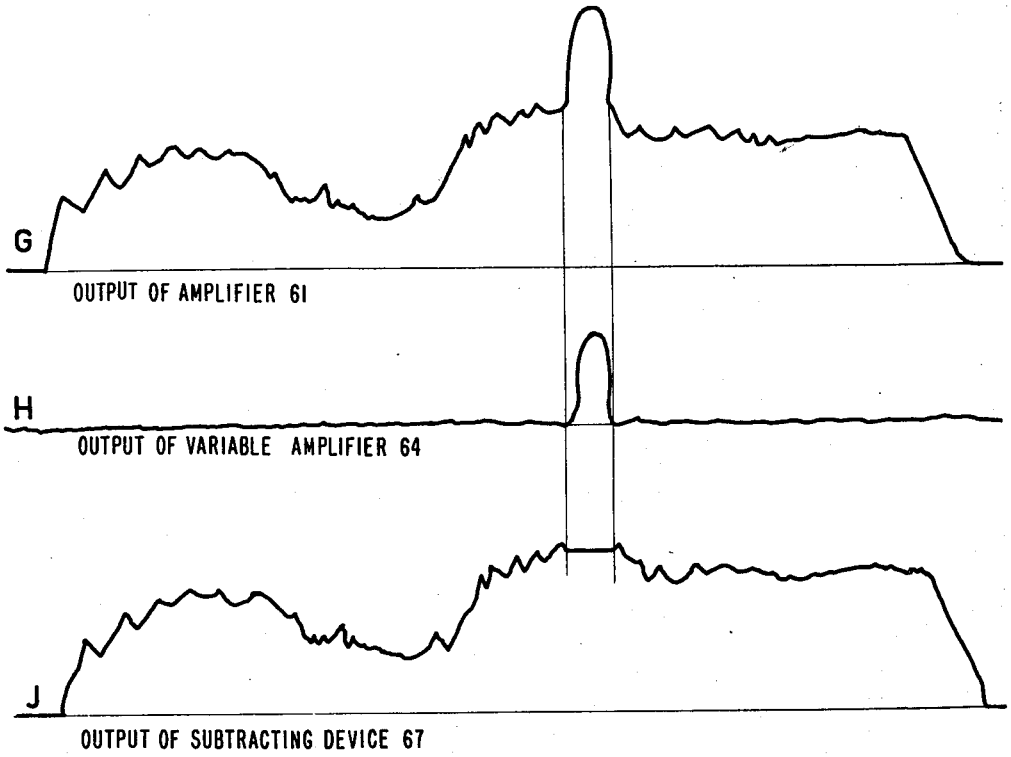
FIG. 4 represents the signals present in the device of FIG. 3.

FIG. 3 shows an alternative embodiment of the processing device according to the invention. According to this alternative embodiment, the signals originating from sensing elements $k_1$ and $k_2$ are respectively amplified in 61 and 62, then the signal from $k_2$ is passed through the delay line 63 to be delayed, then through the variable amplifier 64 to be amplified. Signals G and H (FIG. 4) are thus respectively derived and supply the inputs 65 and 66 of a subtracting device 67. At the output 68 of the subtracting device, a signal such as signal J of FIG. 4 is derived with no peak capable to cause a dazzling area or a dark area to be produced on the display device connected to output 68. To this effect, the gain of the variable amplifier 64 has been previously adjusted by laboratory tests.

In the device according to the invention, a processing device such as been shown in FIG. 1 or FIG. 3 is associated with each pair of the sensing elements of same rank in both sensor bars.

Of course, if it is desired to leave out only the stray signals produced by the missile, it is possible to reduce the number of sensing elements of the second bar and to associate them with the elements located at the centre of the first bar, since in operation the missile is in the centre of the scanned field.

What I claim is:

1. A thermal telescope having a display device associated therewith for the night guidance of a self-propelled missile carrying an infrared tracer towards a target, comprising first detection means sensitive to infrared energy in a first spectral range corresponding to the maximum radiation from the target and the environment thereof, second detection means sensitive to infrared energy in a second spectral range corresponding to the maximum radiation from the tracer, first circuit means connected to the output of said first detection means, second circuit means connected to the output of said second detection means and including means for deriving from the signal from said second detection means a square waveform of same duration, and gate means receiving the output of said first circuit means and having its control input connected to the output of said second circuit means and its output connected to said display device.

2. A thermal telescope according to claim 1, wherein the circuit means connected to one of said detection means includes means for delaying the conveyed signal by a time lag equal to the time elapsed between the instants at which the energy from one and the same portion of the field of view is detected by said one detection means and by the other detection means.

3. A thermal telescope having a display device associated therewith for the night guidance of a self-propelled missile carrying an infrared tracer towards a target, comprising first detection means sensitive to infrared energy in a first spectral range corresponding to the maximum radiation from the target and the environment thereof, second detection means sensitive to infrared energy in a second spectral range corresponding to the maximum radiation from the tracer, first circuit means connected to the output of said first detection means, second circuit means connected to the output of said second detection means and means for subtracting the output of said second circuit means from the output of said first circuit means, said subtractor means having its output connected to said display device.

4. A thermal telescope according to claim 3, wherein said second circuit means includes an adjustable amplifier.

5. A thermal telescope according to claim 3, wherein the circuit means connected to one of said detection means includes means for delaying the conveyed signal by a time lag equal to the time elapsed between the instants at which the energy from one and the same portion of the field of view is detected by said one detection means and by the other detection means.

* * * * *